United States Patent [19]

Kii

[11] 4,218,597

[45] Aug. 19, 1980

[54] GAS-BLAST TYPE CIRCUIT INTERRUPTER

[75] Inventor: Masami Kii, Amagasaki, Japan

[73] Assignee: Mitsubishi Denki Kabushiki Kaisha, Tokyo, Japan

[21] Appl. No.: 889,520

[22] Filed: Mar. 23, 1978

[30] Foreign Application Priority Data

Mar. 24, 1977 [JP] Japan ..... 52/32942
Jun. 27, 1977 [JP] Japan ..... 52/76735

[51] Int. Cl.[2] ..... H01H 33/82

[52] U.S. Cl. ..... 200/148 R; 200/148 B; 200/150 D

[58] Field of Search ..... 200/148 R, 148 A, 148 B, 200/148 C, 148 D, 148 E, 148 F, 148 G, 148 H, 148 J, 148 BV, 145, 147 R, 147 A, 147 B, 144 R, 149 R, 149 A, 149 B, 150 R, 150 A, 150 H, 150 J, 150 JA, 150 L, 150 M, 150 N, 150 BC, 150 D, 150 E, 150 F, 150 G, 151

[56] References Cited

U.S. PATENT DOCUMENTS

| | | | |
|---|---|---|---|
| 1,902,507 | 3/1933 | Juhlin | 200/150 D |
| 3,524,958 | 8/1970 | Frink | 200/150 G X |
| 4,032,736 | 6/1977 | Ruffieux et al. | 200/147 R |
| 4,139,752 | 2/1979 | Itai | 200/148 C |

*Primary Examiner*—Gene Z. Rubinson
*Assistant Examiner*—Morris Ginsburg
*Attorney, Agent, or Firm*—Robert E. Burns; Emmanuel J. Lobato; Bruce L. Adams

[57] ABSTRACT

A circuit interrupter of the self-extinguishing type in which a high pressure fluid generated by an electric arc established between separable contacts is utilized in the extinction of the arc. The interrupter comprises separable contacts, a pressure-raising chamber containing an arc extinguishing gas and an arc extinguishing chamber for puffing and releasing the high pressure arc extinguishing gas at substantially right angles to the electric arc established between the separated contacts.

3 Claims, 4 Drawing Figures

GAS-BLAST TYPE CIRCUIT INTERRUPTER

BACKGROUND OF THE INVENTION

1. Field of the Invention

This invention relates to circuit interrupters of the type in which a high pressure gas generated by an electric arc established between separated contacts is utilized for extinguishing the arc.

2. Description of the Prior Art

Self-extinguishing circuit interrupters utilizing an arc extinguishing fluid as an arc extinguishing medium are known as means for interrupting an electrical path from a power source when an overcurrent flows therethrough.

Conventional circuit interrupters of this type are constructed so that the pressure of a fluid in a confined space of a predetermined inner volume is increased by utilizing the pressure-raising function of the arc energy dissipated from an electric arc itself into a surrounding arc extinguishing fluid. During decrease of the arc current with pulsation, i.e., rapid decrease of the arc energy accompanied by decrease in the arc diameter, the choking by the arc is caused to cease to release the high pressure fluid through an arcing region, thereby cooling and diffusing the arced gas within the arcing region to extinguish the arc.

For such a self-extinguishing type circuit interrupter, although it is critical and indispensable to ensure that the fluid is at a high pressure, since this type of interrupter mainly utilizes the thermal properties of the arc for generating and maintaining the necessary pressure, pressure-raising is enevitably accompanied by temperature-rising, resulting in ionization of the arc extinguishing fluid, decreasing the density of the electrically neutral arc extinguishing fluid, thereby degrading the insulating performance and the arc diffusing and cooling capability of the extinguishing fluid, resulting in poor arc extinguishing performance. This phenomenon is more aggravated with increases in the arc current.

SUMMARY OF THE INVENTION

Accordingly, the chief object of the present invention is to provide a circuit interrupter capable of effectively utilizing the arc energy generated upon separation of the contacts thereby improving the arc extinguishing performance.

With the above object in view, the present invention resides in a circuit interrupter wherein an arc extinguishing fluid is pressurized within a pressure-raising chamber by utilizing the energy of an electric arc itself. The elevation of temperature of the arc extinguishing fluid is suppressed while the necessary pressure is effectively obtained. The cool, high-pressure arc extinguishing fluid is powerfully blasted substantially at right angles to an arc column, thereby quickly and effectively achieving extinction of the arc.

The configuration of the pressure-raising chamber and the cross-sectional area of the communicating port for communicating the pressure-raising chamber with the arcing region are constant irrespective of time change; i.e., they are unrelated to the change in length of the arc column which varies with time during the contact opening operation. Therefore the arc extinguishing fluid is always obtained in the cool and sufficiently pressurized state.

BRIEF DESCRIPTION OF THE DRAWINGS

The present invention will become more readily apparent from the following description of the preferred embodiments of the invention taken in conjunction with the accompanying drawings, in which.

DESCRIPTION OF THE PREFERRED EMBODIMENTS

Figure 2:
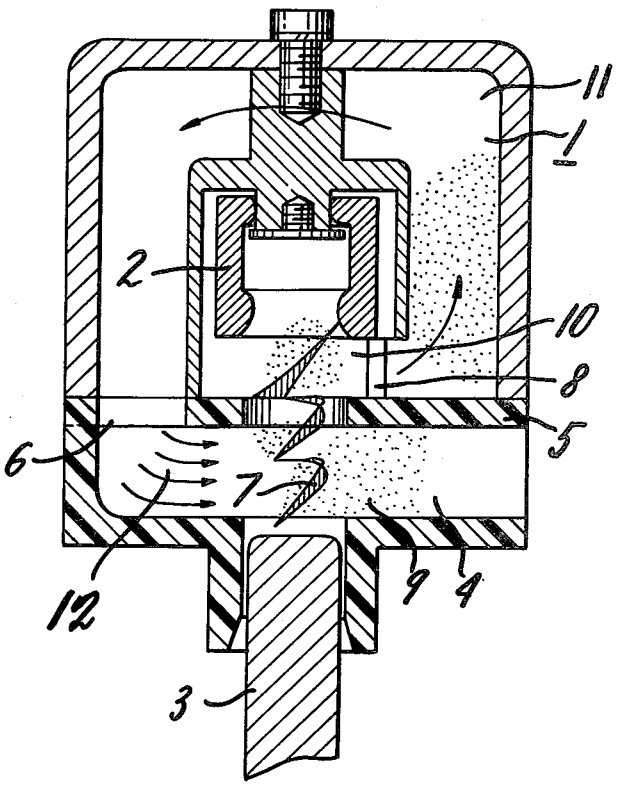
FIG. 2 is a schematic sectional view of the circuit interrupter shown in FIG. 1 in the contact open position.
Figure 1:
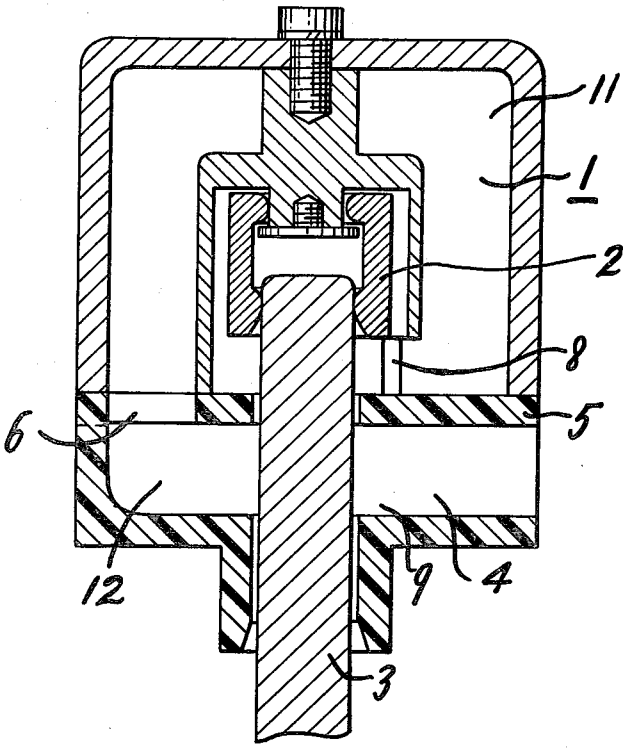
FIG. 1 is a schematic sectional view of a circuit interrupter embodying the present invention.

Referring now to the drawings and in particular to FIG. 1, a circuit interrupter of the present invention comprises an unillustrated casing containing an arc extinguishing gas such as sulfur hexafluoride ($SF_6$) gas. Within the casing a pressure-raising chamber 1 also containing $SF_6$ gas is disposed. The pressure-raising chamber 1 is composed of an upper pressure-raising chamber 11, a lower pressure-raising chamber 12 and a communicating channel 6 communicating the upper and the lower pressure-raising chambers 11 and 12. Within the pressure-raising chamber 1 is disposed a stationary contact 2, and a movable contact 3 in the shape of a rod capable of contacting and separating from the stationary contact 2 is movably supported by an operating mechanism (not shown) of a well-known type. Immediately below the upper pressure-raising chamber 11, an arc extinguishing chamber 4 separated from the pressure-rising chamber 1 by an insulating member 5 is disposed. With the contacts 2 and 3 closed as illustrated in FIG. 1, the lower pressure-raising chamber 12 and the arc extinguishing chamber 4 are substantially isolated by the movable contact 3. In other words, a predetermined length portion 10 (FIG. 2) of the electric arc established between the separated contacts 2 and 3 and above the insulating member 5 is utilized as a pressure-raising arc, and the remaining portion of the arc is isolated from the pressure-raising arc by the insulating member 5. The arc extinguishing chamber 4 disposed under the pressure-raising chamber 1 communicates with the pressure-raising chamber 1, through a communicating channel 6 formed between the pressure-raising chamber 1 and the arc extinguishing chamber 4, and the high pressure fluid pressurized in the pressure raising chamber 1 is directed to the arc portion 7 to be extinguished (see FIG. 2) at substantially right angles as illustrated in FIG. 2, thereby rapidly and effectively diffusing the arc within the arcing region. The arcing region in which the initial arc between the contacts 2 and 3 is established and the pressure-raising chamber 1 communicate with each other through the opening 8, which is located on the opposite side of the communicating channel 6 so that the high temperature, high pressure fluid flows around in the counter-clockwise direction (as viewed in the figure) within the pressure-raising chamber 1 without directly flowing into the arc extinguishing chamber 4. If desired, means for regulating the gas flow may advantageously be provided in the flow path. Also, the pressure-raising chamber 1 has the lower-pressure raising chamber 12 on the left side (as viewed in the figure) of the penetrating contact 3, which chamber defines therein a space of a predetermined volume for containing the fluid. Thus, along with the flow of the high pressure, low temperature fluid from the pressure-raising chamber 1 into the arc extinguishing chamber 4 through the communicating channel 6 and the lower pressure-raising chamber 12, a strong flow of the high pressure, low temperature fluid directed to the arc portion 7 is maintained over the entire length of the arc portion 7 through the opening 9 having a substantially rectangular cross-section elongated in the direction of the axis of the arc.

When a trip command is applied to the unillustrated operating mechanism, the operating mechanism causes the movable contact 3 to move downward. After a predetermined wiping distance between the movable contact 3 and the stationary contact 2 is covered, they are separated from each other to establish an electric arc therebetween as illustrated in FIG. 2. The electric arc increases the pressure of the arc extinguishing fluid within the pressure-raising chamber 1 through the opening 8. Further downward movement of the movable contact 3 causes the electric arc to be extended through the insulating member 5. The pressure-raising arc portion 10 on the upper side of the insulating member 5 keeps increasing the pressure within the pressure-raising chamber 1, but the high temperature fluid temperature-raised by the arc portion 10 is confined in the right-hand (in the figure) portion of the pressure-raising chamber 1 since the temperature diffusion speed is very slow compared to the pressure propagation speed (Arrows in the figure indicate the flow of the fluid).

With the further downward movement of the movable contact 3, the pressure-raising chamber 1 is sufficiently pressure-raised and a low temperature, high pressure fluid fills the pressure-raising chamber 1. The arc portion 7 extending across the arc extinguishing chamber 4 blocks the opening 9 to the extent that it maintains the pressure of the pressure-raised fluid within the pressure-raising chamber 1 and that the pressure-raising chamber 1 is not excessively pressurized, whereby the temperature elevation of the low temperature, high pressure fluid within the pressure-raising chamber 1 is suppressed.

When the arc current starts to decrease under the above described circumstances to rapidly reduce the arc dimensions, the choking or blocking of the opening 19 is ceased to release the low temperature, high pressure fluid in the pressure-raising chamber 1 through the arc extinguishing chamber 4 into the interior space of the casing. The released fluid is flowed and diffused substantially perpendicularly to the cross-section of the opening 9 or to the length of the arc ensuring that a low temperature, high pressure fluid is supplied into the arc extinguishing region to provide an effective arc cooling and diffusing capability. Also, since little effect of the current before arc extinction remains in the arc extinguishing region, the arc extinguishing capability is not reduced even when the arc current is high. Even after the arc extinction has been completed, fresh high pressure fluid is kept supplied into the arcing region since the pressure-raising chamber is large, thereby exhibiting excellent performance even in interruption under severe circuit conditions where the transient recovery-voltage across the separated contacts has a high rate of increase.

Figure 3:
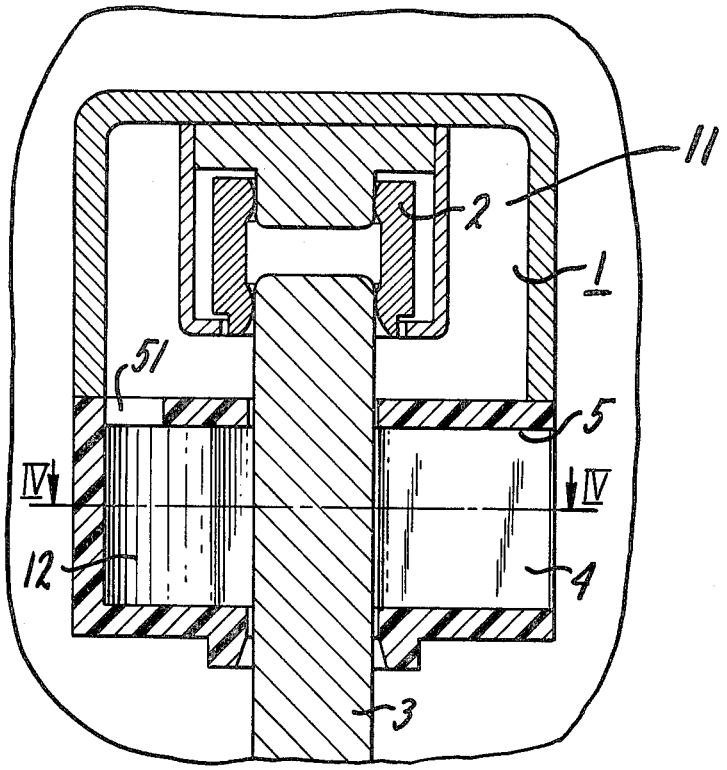
FIG. 3 is a schematic sectional view of another embodiment of the circuit interrupter of the present invention.
Figure 4:
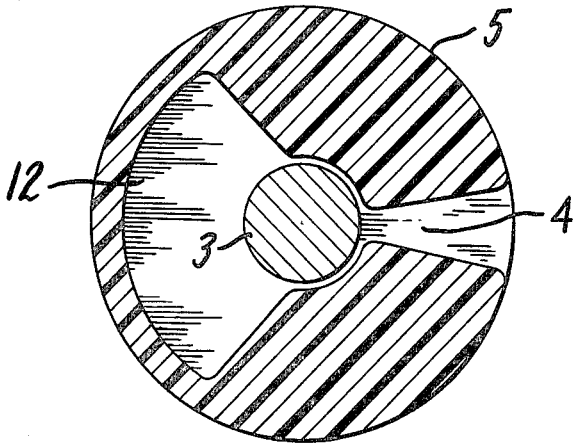
FIG. 4 is a sectional view taken along the line IV—IV in FIG. 3.

FIGS. 3 and 4 illustrate another embodiment of the present invention, wherein the insulating member 5 has formed therein a communicating channel 51 through which the upper pressure-raising chamber 11 is communicated with the lower pressure-raising chamber 12 or the arc extinguishing chamber 4. The arc extinguishing chamber 4 has a plane shape as seen in FIG. 4, with the lower pressure-raising chamber 12 larger than the arc extinguishing chamber 4. Although the illustrated embodiment has a single chamber 4, there may be a plurality of chambers disposed along the length direction of the movable contact 3, thereby promoting the arc extinguishing owing to the partition walls defining a plurality of arc extinguishing chamber 4 openings.

With the circuit interrupter shown in FIGS. 3 and 4, when an electric arc is established between the contacts 2 and 3, the opening of the arc extinguishing chamber 4 is choked by the arc column irrespective of the length of the arc. In other words, the choke conditions are provided by the arc column per unit length thereof at the opening of chamber 4 which has a cross-section with the major length dimension thereof extending in the arc length direction. Therefore, even when the cross-sectional area of the opening is increased by increasing the length of the cross-section, the choking condition does not vary. When the arc current decreases and the arc column is contracted to cease the choking of the opening, the high pressure fluid stored in the lower pressure-raising chamber 12 is blasted at the arc column over the entire length of the arc portion 7 at substantially right angles therewith, thereby diffusing to blast off substantially the entire axial region of the arc column.

The arc extinguishing chamber 4 may be constructed to have a lower pressure-raising chamber 12 having a predetermined inner volume larger than that of the arc extinguishing chamber 4 for performing the function of a pressure-raising chamber, thereby effectively achieving the above described functions. This may be made more efficient if the above two structures are employed in combination.

Although the foregoing description has been made in terms of the particular embodiments of the present invention, the circuit interrupter of the present invention should not be limited to those described above but many modifications and changes may be made without departing from the scope and the spirit of the present invention.

What is claimed is:

1. A gas-blast type circuit interrupter, comprising:

a pair of separable contact members, at least one of which is movable, said pair of contact members having a contacting position wherein they are touching and no electric arc is formed in use between them, and said pair of contact members being separable to define therebetween a progressively increasing distance with a progressively longer electric arc formed in use therebetween and with the electric arc axial length dimension extending between the pair of separated contact members;

an upper pressure-raising chamber for containing in use an electronegative gas the pressure of which is raised in use by an electric arc formed between the separated contacts, both of said contact members being positioned within said upper pressure-raising chamber when said contact members are in the contacting position; and an insulative member having a surface defining a bottom wall of said upper chamber, a bore extending therethrough for defining a path of travel of said at least one movable contact member as said movable contact member moves from the contacting position to progressively separated positions so the electric arc formed between said contact members extends through the bore with the arc axial dimension aligned with the bore, a first cavity defining a lower pressure-raising chamber having an inlet opening into said upper pressure-raising chamber to provide communication between said pressure raising chambers and having an outlet opening into said bore, and a second cavity defining an arc extinguishing chamber having a volume less than that of said lower pressure-raising chamber and an inlet opening into said bore opposite the outlet of said lower pressure-raising chamber and having an outlet for venting gas therefrom, wherein said bore is dimensioned to closely fit said movable contact member and said movable contact member is dimensioned to extend into said bore and block the outlet of said lower pressure-raising chamber and the inlet of said arc extinguishing chamber for preventing communication between said lower pressure-raising chamber and said arc extinguishing chamber when said contact members are in the contacting position;

whereby separation of said contact members in use to establish an electric arc between said separated contact members is effective to raise the pressure of an electronegative gas within said pressure raising chambers, and progressive separation of said contact members to a distance sufficient to displace said movable contact from blocking the outlet of said lower pressure-raising chamber and the inlet of said arc extinguishing chamber is effective to release electronegative gas at a raised pressure through said bore between the outlet of said lower pressure-raising chamber and the inlet of said arc extinguishing chamber and in a direction perpendicular to the axial dimension of the electric arc extending through said bore for extinguishing the electric arc and venting the electronegative gas through said arc extinguishing chamber.

2. A gas-blast type circuit interrupter as claimed in claim 1, further comprising: a wall within said upper pressure-raising chamber surrounding a region wherein an electric arc is formed in use between said contact members, said wall having an opening therethrough on an opposite side of said contact members as the inlet of said lower pressure-raising chamber to permit raising of the electronegative gas pressure by an electric arc between said contact members while inhibiting heating of the electronegative gas by the electric arc.

3. A gas-blast type circuit interrupter as claimed in claim 2, wherein said bore through said insulative member is cylindrical and said at least one movable contact is cylindrical and dimensioned to closely fit within said bore, said lower pressure-raising chamber converges in a direction toward said bore, said arc extinguishing chamber diverges in a direction away from said bore, the outlet of said lower pressure-raising chamber is wider than the inlet of said arc extinguishing chamber, and a major portion of a lateral surface of said at least one movable contact is surrounded by the wall of said bore.

* * * * *